United States Patent [19]

Broughton et al.

[11] Patent Number: 4,799,905

[45] Date of Patent: Jan. 24, 1989

[54] WATER JACKETED EXHAUST RELIEF SYSTEM FOR MARINE PROPULSION DEVICES

[75] Inventors: George L. Broughton, Waukegan, Ill.; Duane E. Rogers, Kenosha, Wis.; David W. Mate, McHenry, Ill.

[73] Assignee: Outboard Marine Corporation, Waukegan, Ill.

[21] Appl. No.: 62,435

[22] Filed: Jun. 12, 1987

[51] Int. Cl.[4] ..... B63H 21/26

[52] U.S. Cl. ..... 440/89; 181/272; 181/235

[58] Field of Search ..... 440/89, 76–78; 181/220, 227, 228, 235, 221, 238, 264–266, 269, 260, 275, 272

[56] References Cited

U.S. PATENT DOCUMENTS

| | | | |
|---|---|---|---|
| 3,045,423 | 7/1962 | Hulsebus | 60/32 |
| 3,198,162 | 8/1965 | Larsen | 115/17 |
| 3,282,373 | 11/1966 | Gazzara | 181/39 |
| 3,296,997 | 1/1967 | Hoiby et al. | 115/0.5 |
| 3,310,022 | 3/1967 | Kollman | 115/17 |
| 3,350,879 | 11/1967 | Boda et al. | 60/31 |
| 3,520,270 | 7/1970 | Miller | 115/17 |
| 3,577,952 | 5/1971 | Tado | 115/17 |
| 3,911,852 | 10/1975 | Miller et al. | 115/17 |
| 3,967,446 | 7/1976 | Harralson et al. | 60/312 |
| 4,019,456 | 4/1977 | Harbert | 115/73 |
| 4,036,162 | 7/1977 | Maier et al. | 115/17 |
| 4,145,988 | 3/1979 | Harada | 115/73 |
| 4,303,401 | 12/1981 | Sanmi et al. | 440/88 |
| 4,354,849 | 10/1982 | Sanmi et al. | 440/88 |
| 4,421,490 | 12/1983 | Nakahama | 440/89 |
| 4,422,519 | 12/1983 | Nomura et al. | 181/228 |
| 4,507,092 | 3/1985 | Hall et al. | 440/89 |
| 4,604,069 | 8/1986 | Taguchi | 440/88 |
| 4,607,723 | 8/1986 | Okazaki | 181/272 |
| 4,668,199 | 5/1987 | Freund et al. | 440/89 |

*Primary Examiner*—Joseph F. Peters, Jr.
*Assistant Examiner*—Edwin L. Swinehart
*Attorney, Agent, or Firm*—Michael, Best & Friedrich

[57] ABSTRACT

Disclosed herein is an inner exhaust gas housing adapted to be located within a drive shaft housing of an outboard motor, which inner exhaust gas housing integrally includes an open upper end, a first exhaust passage extending downwardly from the upper end, a second exhaust passage extending downwardly from the upper end, an expression chamber adjacent the upper end, a first passage communicating between the first and second exhaust passages and the expansion chamber, and a second passage communicating with the expansion chamber and with the atmosphere exterior to the inner exhaust gas housing.

30 Claims, 2 Drawing Sheets

WATER JACKETED EXHAUST RELIEF SYSTEM FOR MARINE PROPULSION DEVICES

RELATED APPLICATIONS

Attention is directed to U.S. application Ser. No. 754,634, filed July 12, 1985 and entitled Water Jacketed Exhaust Relief System For Marine Propulsion Device.

Attention is also directed to U.S. application Ser. No. 58,385, filed on June 4, 1987, and entitled Marine Propulsion Device Low-Speed Exhaust System.

BACKGROUND OF THE INVENTION

This invention relates to marine propulsion devices such as outboard motors and stern drive units and, more particularly, to water jacketed exhaust discharge systems including an exhaust gas relief arrangement.

Exhaust gas from outboard motor internal combustion engines typically is exhausted downwardly through a gas expansion chamber in a drive shaft housing and then discharged into the water through a through-the-hub propeller or the like. The exhaust gas expansion chamber is jacketed with water to cool the exhaust gases and muffle sound.

At higher boat speeds, a low pressure region is created behind the propeller and exhaust gases are easily discharged into the water. At engine idle or lower boat speeds, water backs up through the hub into the exhaust gas expansion chamber and creates a static back pressure which restricts the discharge of the exhaust gases and creates rough engine operating characteristics.

Exhaust relief systems have been provided for venting the exhaust gases to atmosphere during engine idle and low boat speeds through a discharge outlet located in the drive shaft housing.

Examples of prior art constructions including an exhaust releif system are disclosed in the following U.S. Pat. Nos.:

| Patentee | U.S. Pat. No. | Issue Date |
|---|---|---|
| Hulsebus | 3,045,423 | July 24, 1962 |
| Larsen | 3,198,162 | August 3, 1965 |
| Gazzara | 3,282,373 | November 1, 1966 |
| Hoiby et al. | 3,296,997 | January 10, 1967 |
| Kollman | 3,310,022 | March 21, 1967 |
| Boda et al. | 3,350,879 | November 7, 1967 |
| Miller | 3,520,270 | July 14, 1970 |
| Tado | 3,577,952 | May 11, 1971 |
| Miller et al. | 3,911,852 | October 14, 1975 |
| Harralson et al. | 3,967,446 | July 6, 1976 |
| Maier et al. | 4,036,162 | July 19, 1977 |
| Haroert | 4,019,456 | April 26, 1977 |
| Harada | 4,145,988 | March 27, 1979 |
| Sanmi et al. | 4,303,401 | December 1, 1981 |
| Sanmi et al. | 4,354,849 | October 19, 1982 |
| Nakahama | 4,421,490 | December 20, 1983 |
| Hall et al. | 4,507,092 | March 26, 1985 |

SUMMARY OF THE INVENTION

The invention provides a marine propulsion device comprising bracket means adapted to be attached to a boat transom, and a propulsion unit connected to the bracket means for pivotal steering movement in a horizontal plane and for pivotal tilting movement in a vertical plane, which propulsion unit comprises a gear case including an exhaust gas passage, a propeller rotatably supported by the gear case, an engine having first and second exhaust ports, a drive shaft housing including an upper portion supporting the engine and a lower portion fixed to the gear case, and an inner exhaust gas housing supported within the drive shaft housing and defining therebetween a space in surrounding relation to the inner exhaust gas housing, which inner exhaust gas housing includes an upper end, a first exhaust passage extending downwardly from the upper end and communicating with the first engine exhaust port and with the gear case exhaust gas passage, a second exhaust passage extending downwardly from the upper end and communicating with the second engine exhaust port and with the gear case exhaust gas passage, an expansion chamber adjacent the upper end, first passage means communicating between the first and second exhaust passages and the expansion chamber, and second passage means communicating with the expansion chamber and with the space between the drive shaft housing and the inner exhaust gas housing, means for supplying water to the space, and means on one of the drive shaft housing and the inner exhaust gas housing for affording overflow discharge of water from the space at a predetermined level below the second passage means.

The invention also provides a marine propulsion device comprising bracket means adapted to be attached to a boat transom, and a propulsion unit connected to the bracket means for pivotal steering movement in a horizontal plane and for pivotal tilting movement in a vertical plane, which propulsion unit comprises a gear case including an exhaust gas passage, a propeller rotatably supported by the gear case, an engine having first and second exhaust ports, a drive shaft housing including an upper portion supporting the engine and a lower portion fixed to the gear case, and an inner exhaust gas housing supported within the drive shaft housing and defining therebetween a space in surrounding relation to the inner exhaust gas housing, which inner exhaust gas housing includes a front wall, a rear wall spaced from the front wall, and first and second outer side walls spaced from each other and connected with the front wall and the rear wall, which front, rear, and outer side walls define an open upper end and an open lower end, which inner exhaust gas housing also includes a first transverse wall including a lower portion and extending between the outer side walls and between the upper and lower ends to define, between the first transverse wall and the rear wall and between the outer side walls, a first exhaust gas passage and to define, between the lower portion of the first transverse wall and the front wall and between the outer side walls, a lower portion of a second exhaust gas passage, which inner exhaust gas housing also includes a second transverse wall located in forwardly spaced relation to the first transverse wall, extending between the outer side walls and from the upper end to the front wall to define, between the outer side walls and between the front wall and the second transverse wall, a forward expansion chamber, which inner exhaust gas housing also includes first and second inner side walls respectively located in inwardly spaced relation from the first and second outer side walls and in spaced relation to each other and extending between the first and second transverse walls and from the upper end and, respectively, to the first and second outer side walls to define an upper portion of the second exhaust gas passage, said upper and lower portions of the second exhaust gas passage communicating with each other, which first inner side wall and the first outer side wall, together with the first and second transverse walls, define a first side expansion chamber, which second inner side wall and which second outer side wall, together with the first and second transverse walls, define a second side expansion chamber, first and second ports in the first transverse wall and communicating respectively between the first and second side expansion chambers and the first exhaust gas passage, first and second ports in the second transverse wall and communicating respectively between the first and second side expansion chambers and the forward expansion chamber, and first and second ports located respectively in the first and second inner side walls and respectively communicating between the first and second side expansion chambers and the second exhaust gas passage.

The invention also provides an inner exhaust gas housing including an upper end, a first exhaust passage extending downwardly from the upper end, a second exhaust passage extending downwardly from the upper end, an expansion chamber adjacent the upper end, first passage means communicating between the first and second exhaust passages and the expansion chamber, and second passage means communicating with the expansion chamber and with the atmosphere exterior to the inner exhaust gas housing.

The invention also provides an inner exhaust gas housing including a front wall, a rear wall spaced from the front wall, and first and second outer side walls spaced from each other and connected with the front wall and the rear wall, the front, rear, and outer side walls defining an open upper end and an open lower end, which inner exhaust gas housing also includes a first transverse wall which includes a lower portion and which extends between the outer side walls and between the upper and lower ends to define, between the first transverse wall and the rear wall and between the outer side walls, a first exhaust gas passage and to define, between the lower portion of the first transverse wall and the front wall and between the outer side walls, a lower portion of a second exhaust gas passage, which inner exhaust gas housing also includes a second transverse wall located in forwardly spaced relation to the first transverse wall, extending between the outer side walls and from the upper end to the front wall to define between the outer side walls and between the front wall and the second transverse wall a forward expansion chamber, which inner exhaust gas housing also includes first and second inner side walls respectively located in inwardly spaced relation from the first and second outer side walls and in spaced relation to each other and extending between the first and second transverse walls and from the upper end and, respectively, to the first and second outer side walls to define an upper portion of the second exhaust gas passage, which upper and lower portions of the second exhaust gas passage communicate with each other, which first inner side wall and the first outer side wall, together with the first and second transverse walls, define a first side expansion chamber, which second inner side wall and the second outer side wall, together with the first and second transverse walls, define a second side expansion chamber, first and second ports in the first transverse wall and communicating respectively between the first and second side expansion chambers and the first exhaust gas passage, first and second ports in the second transverse wall and communicating respectively between the first and second side expansion chambers and the forward expansion chamber, and first and second ports located respectively in the first and second inner side walls and respectively communicating between the first and second side expansion chambers and the second exhaust gas passage.

One of the principal features of the invention is the provision of a marine propulsion device wherein the exhaust relief system is arranged to reduce noise during engine idle and lower boat speeds.

Another principal feature of the invention is the provision of an inner exhaust gas housing including first and second exhaust passages extending downwardly from the upper end of the housing, an expansion chamber adjacent the upper end, first passage means communicating between the first and second exhaust passages and the expansion chamber, and second passage means communicating with the expansion chamber and with the atmosphere exterior to the housing.

Another principal feature of the invention is the provision of an exhaust system which attenuates both high and low frequency noise.

Another principal feature of the invention is the provision of an exhaust system which isolates or separates the acoustical waves traveling to and from the different cylinder groups. This substantially prevents or reduces interference with the exhaust tuning of the cylinder groups and increases horsepower output.

Another principal feature of the invention is the provision of a low-speed exhaust relief system which discharges "dry" exhaust gas. In other words, the exhaust gas does not travel through water and absorb moisture.

Other features, aspects and advantages of the invention will become apparent to those skilled in the art upon reviewing the following detailed description, the drawings and the appended claims.

Figure 1:
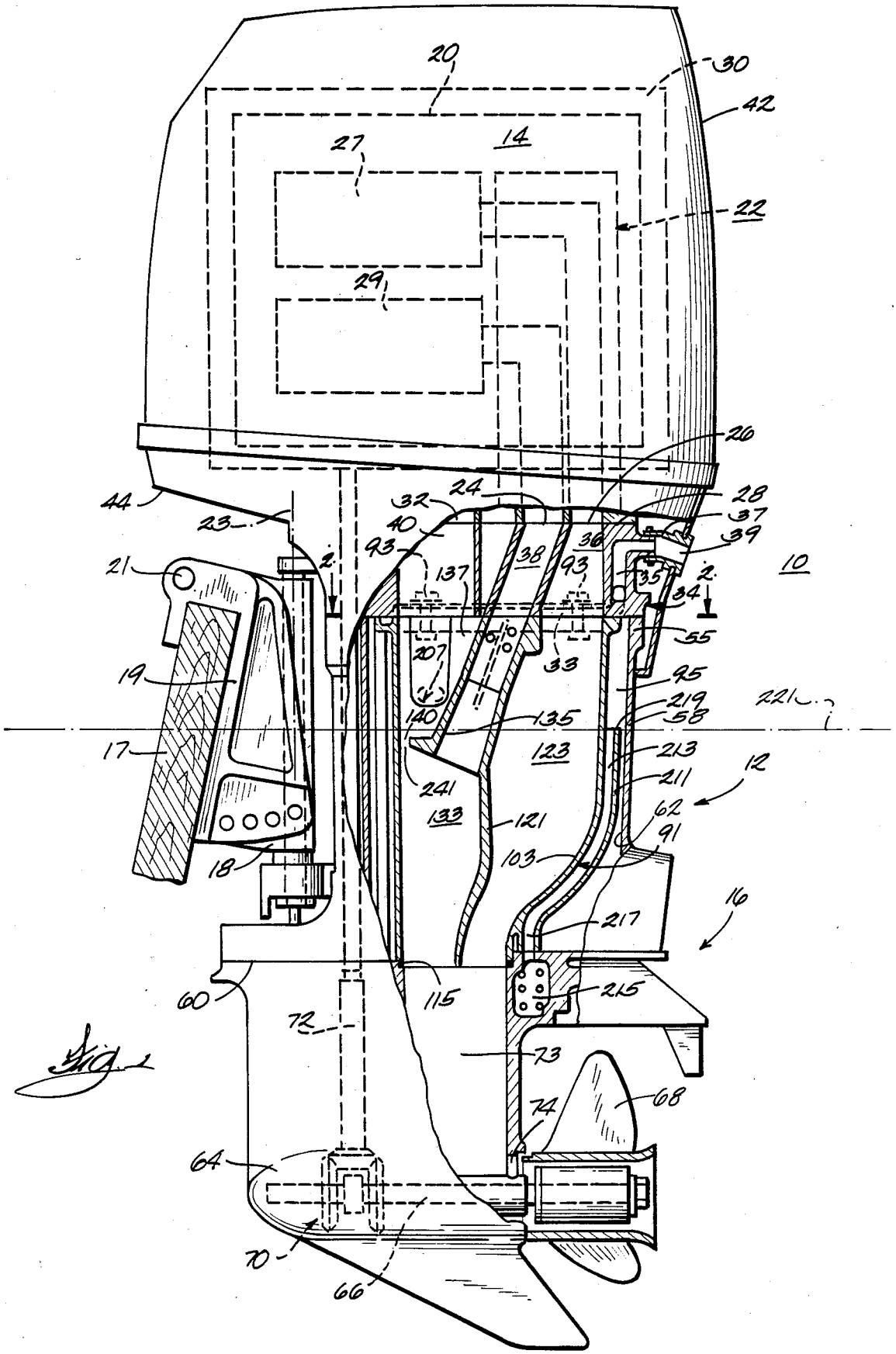
FIG. 1 is a side elevation view, partially broken away and in section, of a marine propulsion device embodying various of the features of the invention.

Before explaining at least one of the embodiments of the invention in detail, it is to be understood that the invention is not limited in its application to the details of construction and the arrangement of components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

DESCRIPTION OF THE PREFERRED EMBODIMENTS

Illustrated in FIG. 1 is a marine propulsion device in the form of an outboard motor 10 having a propulsion unit 12 including an upper unit or power head 14, and a lower unit 16 fixedly connected to the lower end of the power head 14. In addition, there is provided means adapted for supporting the lower unit 16 and thus the propulsion unit 12 from a boat transom 17, including a swivel bracket 18 and a transom bracket 19, for outward swinging movement of the lower unit 16 (and propulsion unit 12) about a horizontal tilt axis 21 and for pivotal movement about a steering axis 23 transverse to the tilt axis.

The power head 14 includes an internal combustion engine 20 having an exhaust gas system 22 comprising a pair of ports or first and second outlets 24 and 26 in the bottom 28 of the engine 20, as well as a cooling water jacket 30 and a water jacket discharge port 32 in the bottom 28 of the engine. The exhaust gas outlet 26 communicates with a first group 27 of one or more cylinders and the exhaust gas outlet 24 communicates with a second group 29 of one or more different cylinders. In the illustrated construction, each cylinder group includes four cylinders. However, the cylinder groups could include more or less than four cylinders.

The power head 14 also includes an adaptor 34 which is bolted or otherwise fixedly connected to the bottom 28 of the engine 20 and has passages 36, 38, and 40, respectively communicating with the engine exhaust gas outlets 26 and 24 and with the water jacket discharge port 32. The adaptor also includes, along the undersurface thereof, an idle exhaust passage 33, together with an interior passage 35 which communicates through a boot 37 with an idle exhaust outlet 39 in a cover 42 still to be described.

The power head 14 further includes a housing or cover 42 covering the engine 20 and the adaptor 34 and having a lower section 44 suitably mounted on the power head 14 and/or the lower unit 16.

The lower unit 16 has an upper end 55 fixedly connected to the lower end of the power head 14, i.e., to the lower end of the adaptor 34, and further includes an outer drive shaft housing 58 having a bottom 60 and an interior surface 62, and a gear case 64 fixedly connected to the bottom 60 of the drive shaft housing 58. The gear case 64 is submerged in water for operation of the propulsion unit 12 and supports a rotatable propeller shaft 66 carrying a propeller 68.

The gear case 64 houses a suitable reversing transmission 70 which drivingly connects the propeller shaft 66 to a drive shaft 72 which extends through the drive shaft housing 58 and which is drivingly connected to the engine 20. The gear case 64 also includes a lower exhaust gas passage 73 having a discharge outlet 74 which, in the specific construction illustrated, is a through-the-propeller hub type. Other conventional types of exhaust gas discharge outlet systems can be used.

Supported by the propulsion unit 12, within the drive shaft housing 58, is an inner exhaust gas housing 91. Various arrangements can be employed for supporting the inner exhaust gas housing 91. In the disclosed construction, the inner exhaust gas housing 91 is connected, by a plurality of bolts 93, to the under surface of the adapter 34 and defines, exteriorly of, and in cooperation with the drive shaft housing 58, a space 95 which surrounds the inner exhaust gas housing 91.

Figure 2:
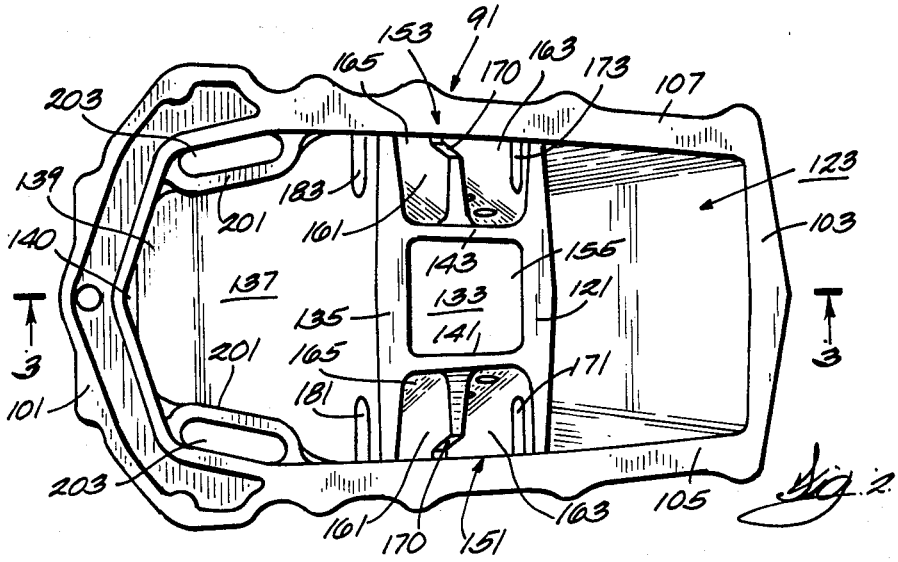
FIG. 2 is an enlarged sectional view taken generally along line 2—2 in FIG. 1.
Figure 3:
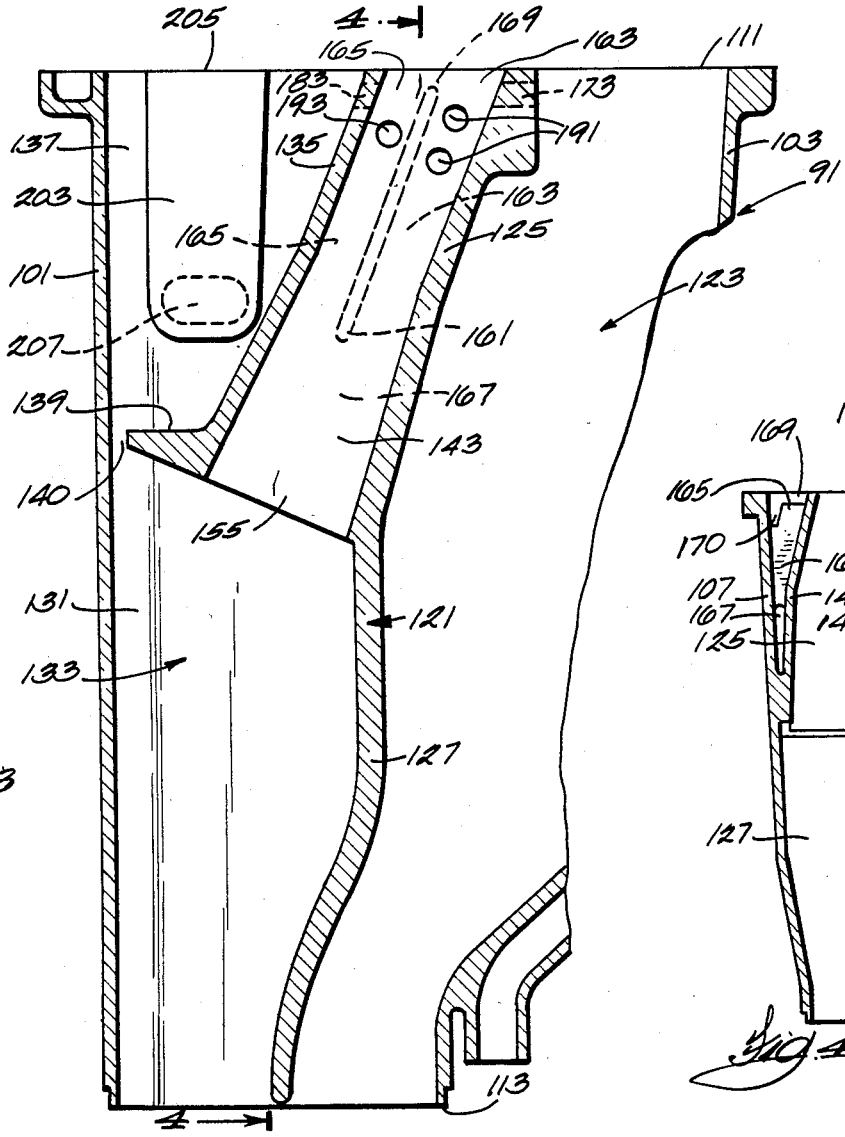
FIG. 3 is a sectional view taken generally along line 3—3 in FIG. 2.

The inner exhaust gas housing 91 includes, see FIGS. 1 and 2, an outer wall comprising a front 101, a rear wall 103 spaced rearwardly from the front wall 101, and a pair of left and right outer side walls 105 and 107 located in laterally spaced relation to each other and extending between the front and rear walls 101 and 103. The front, rear, and outer side walls 101, 103, 105, and 107 have upper terminal portions which define an open upper end 111 (FIG. 3) and which are connected, as by the bolts 93, to the adaptor 34. In addition, the front, rear, and outer side walls 101, 103, 105, and 107 have lower terminal portions which define an open lower end 113 which is received (See FIG. 1) on a water tight gasket 115 supported near the bottom of the drive shaft housing 58 by either the drive shaft housing 58 or the gear case 64.

The inner exhaust gas housing 91 also includes a first or rearward transverse wall 121 extending from the upper end 111 to the lower end 113 and between the outer side walls 105 and 107 to define, between the rearward transverse wall 121 and the rear wall 103 and between the outer side walls 105 and 107, a first or rearward exhaust gas passage 123 which communicates, at its upper end, with the rearward exhaust gas passage 36 in the adaptor 34 and which communicates, at its lower end, with the exhaust gas passage 73 in the gear case 64.

The rearward transverse wall 121 includes upper and lower portions 125 and 127. Defined between the lower portion 127 and the front wall 101, and between the outer side walls 105 and 107, is a lower part or portion 131 of a second or forward exhaust gas passage 133 which extends to the lower end 113 and communicates with the exhaust gas passage 73 in the gear case 64.

The inner exhaust gas housing 91 also includes a second or forward transverse wall 135 which extends between the outer side walls 105 and 107 and from the upper end 111 to the front wall 101 to define a relatively large forward expansion chamber 137 located between the outer side walls 105 and 107 and between the forward transverse wall 135 and the front wall 101. The lower portion of the forward transverse wall 135 forms a bottom wall 139 of the forward expansion chamber 137. The bottom wall 139 terminates just short of a central portion of the forward wall 101 to define a restricted passage 140. The passage 140 allows water to drain out of the forward chamber 137 and also, under certain conditions explained hereinafter, permits exhaust gas flow into the forward chamber 137.

The inner exhaust gas housing 91 also includes (see FIGS. 2 and 4) left and right inner side walls 141 and 143 extending between the rearward or first transverse wall 121 and the forward or second transverse wall 135 and from the upper end 111 and respectively to the left and right outer side walls 105 and 107 to define left and right side expansion chambers 151 and 153 which are relatively small as compared to the forward expansion chamber 137 and which are located between the rearward and forward transverse walls 121 and 135 and between the inner and outer side walls 105 and 107. Defined between the upper portion 125 of the rearward transverse wall 121 and the forward transverse wall 135 and between the inner side walls 141 and 143 is an upper portion or part 155 of the exhaust passage 133, which upper part 155 communicates with the lower part 131 of the forward exhaust gas passage 133.

Figure 4:
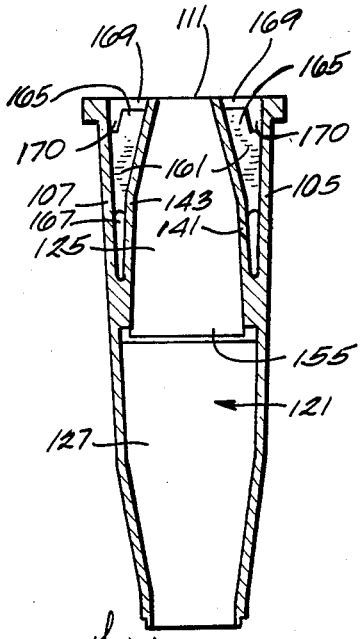
FIG. 4 is a reduced sectional view taken generally along line 4—4 in FIG. 3.

The side expansion chambers 151 and 153 include respective vertical ribs, baffles, or partitions 161 which define rearward and forward sub-chambers 163 and 165 and which extend between the adjacent inner side walls 141 and 143 and the associated outer side walls 105 and 107 and, as shown in FIG. 4, from the upper end 111 to a location in spaced relation to the connection of the inner side walls 141 and 143 to the outer side walls 105 and 107 to provide passages 167 between the rearward and forward sub-chambers 163 and 165.

If greater attenuation of noise is not desired, the upper ends of the partitions or baffles 161 can terminate in slightly spaced relation below the upper end 111 to provide passages or ports 169 and can additionally be notched as shown, in FIGS. 2 and 4, at 170 to provide, wit the passages 169, restricted shunt paths for idle exhaust gas flow around, or in by-passing relation to, the sub-chambers 163 and 165.

The rearward transverse wall 121 includes, (See FIG. 2) adjacent the top thereof, first and second or left and right restricted passages or ports 171 and 173 which respectively communicate between the rearward exhaust gas passage 123 and the rear sub-chambers 163 of the side expansion chambers 151 and 153.

The forward transverse wall 135 includes, adjacent the top thereof, left and right restricted passages or ports 181 and 183 which respectively communicate between the left and right side expansion chambers 151 and 153 and the forward expansion chamber 137.

Each of the inner side walls 141 and 143 includes, (See FIG. 3) adjacent the top thereof, one or more ports which communicate between the upper portion 155 of the forward exhaust gas passage 133 and the adjacent side expansion chamber. In the disclosed construction, each of the side walls 141 and 143 includes two ports 191 communicating between the forward exhaust gas passage 133 and the associated rear sub-chamber 163 of the side expansion chambers 151 and 153, and one port 193 communicating between the forward exhaust gas passage 133 and the associated front sub-chamber 165. Other variations can be employed.

The side expansion chambers 151 and 153, and the ports or passages 167, 169, 170, 171, 173, 181, 183, 191, and 193 just described, provide a first restricted gas passage means between the rearward and forward exhaust gas passages 123 and 133 and the forward expansion chamber 137, and facilitate attenuation of exhaust noise, and particularly, high frequency noise. Other specific constructions and other variations can be employed within the scope of the invention.

The inner exhaust gas housing 91 also includes second restricted gas passage means communicating between the forward expansion chamber 137 and the space 95 between the drive shaft housing 58 and the inner exhaust gas housing 91. While various constructions can be employed, in the disclosed construction, such means includes, at each side of the inner exhaust gas housing, an inner wall 201 which defines a vertical passage 203 having (See FIG. 3) an inlet end 205 adjacent the upper end 111. At its lower end, the passage 203 communicates through a port 207, in the associated one of the outer side walls 105 and 107, with the space 95.

Any suitable means can be provided for supplying water to the space 95 to obtain a water jacket in surrounding relation to the inner exhaust gas housing 91. In the disclosed construction, discharge water from an engine coolant jacket 30 is dumped into the space 95 by conduit means extending in the engine and terminating in the discharge 32, and by the passage 40 in the adaptor 34.

Means are also included for providing overflow discharge of water from the space 95. While various constructions can be employed, in the illustrated construction, the inner exhaust gas housing 91 includes (see FIG. 1) an additional wall 211 connected to the rear wall 103 and forming, with the rear wall 103, a vertical discharge passage 213 having a lower end 217 communicating with a discharge outlet 215 in the lower part of the drive shaft housing 58 or in the gear case 64, and an upper end 219 which serves to establish the top of the resulting water jacket. The upper end 219 is located at a level 221 below the ports 207 so that, at normal idle operation, the water jacket is below the ports 207 and the exhaust gas which passes through the ports 207 does not take up or absorb water, i.e., is "dry". The water level 221 is normally slightly above the bottom 139 of the front expansion chamber 137.

In operation, under idle or low speed operating conditions, the drive shaft housing 58 normally extends well into the water and water rises into the inner exhaust gas housing 91 to the neighborhood of the level 221. Under such circumstances, the exhaust gas in the rearward exhaust gas passage 123 will escape through the ports 171 and 173 in the rearward transverse wall 121 into the side expansion chambers 151 and 153 and the exhaust gas in the forward exhaust gas passage 133 will escape through the Ports 191 and 193 in the inner side walls 141 and 143 into the side expansion chambers 151 and 153. Some of the exhaust gas entering the rear sub-chambers 163 of the side expansion chambers 151 and 153 will travel downwardly in the rear sub-chambers 163, through the passages 167, and then up the front sub-chambers 165 and will then pass through the ports 181 and 183 into the forward expansion chamber 137. Some of the exhaust gas entering into the rear sub-chambers 163 of the side expansion chambers 151 and 153 will pass straight through from the rear sub-chambers 163 to the front sub-chambers 165 by passage through the passages 169 and the notches 170 and above the partitions 161 and then through the ports 181 and 183 into the forward expansion chamber 137. The exhaust gas entering the forward sub-chambers 165 of the side chambers 151 and 153 will pass through the parts 181 and 183 into the forward expansion chamber 137.

From the forward expansion chamber 137, the idle exhaust gas will flow through the entry ends 205 of the vertical passages 203 and out the ports 207 into the space 95 above the water jacket and then to the passage 33 on the underside of the adaptor 34. Thereafter, idle exhaust gas will flow up the passage 35 in the adaptor 34 and then out of the idle exhaust gas discharge outlet 39.

In the event the exhaust gas flow from the forward passage 133 through the ports 191 and 193 is insufficient under low speed operation of the engine 20, the exhaust gas pressure will downwardly displace sufficient water out of the forward exhaust gas passage 133 to open up the opening 140 into the bottom of the forward expansion chamber 137 and allow additional exhaust gas flow through this route.

It is noted that exhaust gas travel through the relatively restricted ports 171, 173, 191, and 193 into the relatively small side expansion chambers 151 and 153 serves to attenuate high frequency noise and that exhaust gas travel through the relatively restricted ports 181 and 183 into the relatively large forward expansion chamber 137 serves to attenuate low frequency noise.

Furthermore, the extension of the first or rearward tranverse wall 121 to adjacent the bottom of the inner exhaust gas housing 91 serves generally to isolate the group of cylinders associated with the rearward exhaust gas passage 123 from the group of cylinders associated with the forward exhaust gas passage 133. Thus, in general, acoustical waves traveling to and from the group of cylinders associated with the rearward exhaust gas passage 121 will not intermix with, or interfere with, the acoustical waves traveling to and from the group of cylinders associated with the forward exhaust passage 133 until mixture in the exhaust gas passage 73 in the gear case 64. Such separation of the acoustical flows from the two groups of cylinders reduces, or substantially prevents, interference with the exhaust tuning of the cylinder groups and increases horsepower output.

Thus, the disclosed inner exhaust gas housing 91 together with the drive shaft housing 58 and the adaptor 34, provide means for attenuating high frequency noise, for attenuating low frequency noise, for isolating from each other the acoustical flows associated with the cylinder groups respectively associated with the first and second exhaust passages 123 and 133, and facilitate discharge of "dry" idle exhaust gas, i.e., exhaust gas which does not travel through water and absorb moisture therein.

In addition, the opening 140 between the forward expansion chamber 137 and the lower portion of the forward exhaust gas passage 133 affords increased opportunity for idle exhaust gas flow to the forward expansion chamber 137 from the forward exhaust gas passage 133.

It is also noted that, in general, the upper portion of the forward exhaust gas passage 133 generally diverges or increases in cross section from the top to the bottom so as to assist in providing optimum tuning to the associated group of engine cylinders over a range of engine speeds.

It is further noted that the ribs 161 and the portions of the transverse walls 121 and 135 extending from the inner side walls 141 and 143 to the outer side walls 105 and 107 also facilitate heat transfer from the exhaust gas passage 133 to the outer walls of the inner housing 91, and that the ribs 161, transverse walls 121 and 135, and inner side walls 141 and 143 rigidify the inner housing 91. Furthermore, the inner housing 91 is preferably made by the lost foam casting process, and the ribs 161 and walls 121, 135, 141 and 143 of the corresponding foam pattern for the inner housing 91 rigidify the foam pattern and improve the formation of the inner housing 91 by causing turbulent flow of molten metal into the pattern.

Various of the features of the invention are set forth in the following claims.

We claim:

1. A marine propulsion device comprising bracket means adapted to be attached to a boat transom, and a propulsion unit connected to said bracket means for pivotal steering movement in a horizontal plane and for pivotal tilting movement in a vertical plane, said propulsion unit comprising a gear case including an exhaust gas passage, a propeller rotatably supported by said gear case, an engine having first and second exhaust ports, a drive shaft housing including an upper portion supporting said engine and a lower portion fixed to said gear case, and an inner exhaust gas housing supported within said drive shaft housing and defining therebetween a space in surrounding relation to said inner exhaust gas housing, said inner exhaust gas housing including an upper end, a first exhaust passage extending downwardly from said upper end and communicating with said first engine exhaust port and with said gear case exhaust gas passage, a second exhaust passage extending downwardly from said upper end and communicating with said second engine exhaust port and with said gear case exhaust gas passage, an expansion chamber adjacent said upper end, first passage means communicating between said first and second exhaust passages and said expansion chamber, and second passage means communicating with said expansion chamber and with said space between said drive shaft housing and said inner exhaust gas housing, and means for supplying water to said space.

2. A marine propulsion device in accordance with claim 1 wherein said second passage means includes a restricted entry end adjacent said upper end and a restricted discharge end located below said entry end.

3. A marine propulsion device in accordance with claim 2 wherein one of said entry end and said discharge end extends through said inner exhaust gas housing from the interior thereof to the exterior thereof.

4. A marine propulsion device as set forth in claim 1 and further comprising means on one of said drive shaft housing and said inner exhaust gas housing for affording overflow discharge of water from said space at a predetermined level below said second passage means.

5. A marine propulsion device in accordance with claim 4 wherein said inner exhaust housing has a front and a rear, wherein said expansion chamber is located at said front, wherein said first exhaust passage is located at the rear, and wherein said second exhaust gas passage is located between said expansion chamber and said first exhaust passage.

6. A marine propulsion device in accordance with claim 5 wherein said expansion chamber is defined, in part, by a bottom wall, and wherein said device further comprises restricted passage means in said bottom wall between said second exhaust passage and said expansion chamber.

7. A marine propulsion device in accordance with claim 5 wherein said bottom wall is located below said predetermined level.

8. A marine propulsion device in accordance with claim 1 wherein said inner exhaust gas housing includes outer side walls, wherein said second exhaust passage includes an upper portion partially defined by spaced inner side walls located in spaced relation to each other and to said outer side walls to respectively define, between said inner and outer side walls and between said expansion chamber and said first exhaust passage, first and second side expansion chambers forming part of said first passage means.

9. A marine propulsion device in accordance with claim 8 wherein said first and second side expansion chambers respectively have bottoms and include therein transverse baffles extending between the associated inner and outer side walls to define first and second sub-chambers, said baffles terminating above the bottoms of said side expansion chambers to afford communication between said first and second sub-chambers.

10. A marine propulsion device comprising bracket means adapted to be attached to a boat transom, and a propulsion unit connected to said bracket means for pivotal steering movement in a horizontal plane and for pivotal tilting movement in a vertical plane, said propulsion unit comprising a gear case including an exhaust gas passage, a propeller rotatably supported by said gear case, an engine having first and second exhaust ports, a drive shaft housing including an upper portion supporting said engine and a lower portion fixed to said gear case, and an inner exhaust gas housing supported within said drive shaft housing and defining therebetween a space in surrounding relation to said inner exhaust gas housing, said inner exhaust gas housing including a front wall, a rear wall spaced from said front wall, and first and second outer side walls spaced from each other and connected with said front wall and said rear wall, said front, rear, and outer side walls defining an open upper end and an open lower end, said inner exhaust gas housing also including a first transverse wall which includes a lower portion and which extends between said outer side walls and between said upper and lower ends to define, between said first transverse wall and said rear wall and between said outer side walls, a first exhaust gas passage communicating with said first engine exhaust port and with said exhaust gas passage in said gear case, and to define, between said lower portion of said first transverse wall and said front wall and between said outer side walls, a lower portion of a second exhaust gas passage, said inner exhaust gas housing also including a second transverse wall located in forwardly spaced relation to said first transverse wall, extending between said outer side walls and from said upper end and to said front wall to define, between said outer side walls and between said front wall and said second transverse wall, a forward expansion chamber, said inner exhaust gas housing also including first and second inner side walls respectively located in inwardly spaced relation from said first and second outer side walls and in spaced relation to each other and extending between said first and second transverse walls and from said upper end and, respectively, to said first and second outer side walls to define an upper portion of said second exhaust gas Passage, said upper and lower portions of said second exhaust gas passage communicating with each other, with said second engine exhaust port, and with said exhaust gas passage in said gear case, said first inner side wall and said first outer side wall, together with said first and second transverse walls, defining a first side expansion chamber, said second inner side wall and said second outer side wall, together with said first and second transverse walls, defining a second side expansion chamber, first and second ports in said first transverse wall and communicating respectively between said first and second side expansion chambers and said first exhaust gas passage, first and second ports in said second transverse wall communicating respectively between said first and second side expansion chambers and said forward expansion chamber, and first and second ports located respectively in said first and second inner side walls and respectively communicating between said first and second side expansion chambers and said second exhaust gas passage.

11. An inner exhaust gas housing adapted to be located within a drive shaft housing of a marine propulsion device, said inner exhaust gas housing including integral wall means defining an outer wall defining an open upper end, a first exhaust passage extending downwardly from said upper end and within said outer wall, a second exhaust passage extending downwardly from said upper end and within said outer wall, an expansion chamber adjacent said upper end and within said outer wall, first passage means communicating between said first and second exhaust passages and said expansion chamber, and second passage means communicating with said expansion chamber and with the atmosphere exterior to said inner exhaust gas housing.

12. An inner exhaust gas housing in accordance with claim 11 wherein said second passage means comprises a restricted entry end adjacent said upper end and a restricted discharge end located below said entry end.

13. An inner exhaust gas housing in accordance with claim 12 wherein one of said entry end and said discharge end extends through said inner exhaust gas housing from the interior thereof to the exterior thereof.

14. An inner exhaust gas housing in accordance with claim 11 wherein said inner exhaust housing has a front and a rear, wherein said expansion chamber is located at said front, wherein said first exhaust passage is located at the rear, and wherein said second exhaust gas passage is located between said expansion chamber and said first exhaust passage.

15. An inner exhaust gas housing in accordance with claim 14 wherein said expansion chamber is defined, in part, by a bottom wall, and wherein said device further comprises restricted passage means in said bottom wall between said second exhaust passage and said expansion chamber.

16. An inner exhaust gas housing in accordance with claim 15 wherein said bottom wall is located below the communication between said expansion chamber and the atmosphere.

17. An inner exhaust gas housing in accordance with claim 11 wherein said inner exhaust gas housing includes outer side walls, wherein said second exhaust passage includes an upper portion partially defined by spaced inner side walls located in spaced relation to each other and to said outer side walls to respectively define, between said inner and outer side walls and between said expansion chamber and said first exhaust gas passage, first and second side expansion chambers forming part of said first passage means.

18. An inner exhaust gas housing in accordance with claim 17 wherein said first and second side expansion chambers respectively have bottoms and include therein transverse baffles extending between the associated inner and outer side walls to define first and second sub-chambers, said baffles terminating above the bottoms of said side expansion chambers to afford communication between said first and second sub-chambers.

19. An inner exhaust gas housing including a front wall, a rear wall spaced from said front wall, and first and second outer side walls spaced from each other and connected with said front wall and said rear wall, said front, rear, and outer side walls defining an open upper end and an open lower end, said inner exhaust gas housing also including a first transverse wall which includes a lower portion and which extends between said outer side walls and between said upper and lower ends to define, between said first transverse wall and said rear wall and between said outer side walls, a first exhaust gas passage and to define, between said lower portion of said first transverse wall and said front wall and between said outer side walls, a lower portion of a second exhaust gas passage, said inner exhaust gas housing also including a second transverse wall located in forwardly spaced relation to said first transverse wall, extending between said outer side walls and from said upper end to said front wall to define, between said outer side walls and between said front wall and said second transverse wall, a forward expansion chamber, said inner exhaust gas housing also including first and second inner side walls respectively located in inwardly spaced relation from said first and second outer side walls and in spaced relation to each other and extending between said first and second transverse walls and from said upper end and, respectively, to said first and second outer side walls to define an upper portion of said second exhaust gas passage, said upper and lower portions of said second exhaust gas passage communicating with each other, said first inner side wall and said first outer side wall, together with said first and second transverse walls, defining a first side expansion chamber, said second inner side wall and said second outer side wall, together with said first and second transverse walls, defining a second side expansion chamber, first and second ports in said first transverse wall and communicating respectively between said first and second side expansion chambers and said first exhaust gas passage, first and second ports in said second transverse wall and communicating respectively between said first and second side expansion chambers and said forward expansion chamber, and first and second ports located respectively in said first and second inner side walls and respectively communicating between said first and second side expansion chambers and said second exhaust gas passage.

20. An inner exhaust gas housing adapted to be located within a drive shaft housing of a marine propulsion device, said inner exhaust gas housing comprising a single piece including integral wall means defining an outer wall defining an open upper end, an exhaust gas passage extending downwardly from said upper end and within said outer wall, an expansion chamber adjacent said upper end and within said outer wall, and passage means communicating between said exhaust passage and said expansion chamber.

21. An inner exhaust gas housing in accordance with claim 20 wherein said inner exhaust housing has a front and a rear, wherein said expansion chamber is located at said front, and wherein said exhaust gas passage is located rearwardly of said expansion chamber.

22. An inner exhaust has housing in accordance with claim 21 wherein said expansion chamber is defined, in part, by a bottom wall, and wherein said device further comprises restricted passage means in said bottom wall between said exhaust gas passage and said expansion chamber.

23. An inner exhaust gas housing in accordance with claim 22 wherein said bottom wall is located below said upper end.

24. An inner exhaust gas housing in accordance with claim 20 wherein said outer wall includes outer side walls, wherein said exhaust gas passage includes an upper portion partially defined by spaced inner side walls located in spaced relation to each other and to said outer side walls to respectively define, between said inner and outer side walls, additional first and second side expansion chambers forming part of said passage means.

25. An inner exhaust gas housing in accordance with claim 24 wherein said additional first and second side expansion chambers respectively have bottoms and include therein transverse baffles extending between the associated inner and outer side walls to define first and second sub-chambers, said baffles terminating above the bottoms of said side expansion chambers to afford communication between said first and second sub-chambers.

26. A marine propulsion device comprising bracket means adapted to be attached to a boat transom, and a propulsion unit connected to said bracket means for pivotal steering movement in a horizontal plane and for pivotal tilting movement in a vertical plane, said propulsion unit comprising a gear case including an exhaust gas passage, a propeller shaft rotatably supported by said gear case, an engine having an exhaust gas port, a drive shaft housing including an upper portion supporting said engine and a lower portion fixed to said gear case, and an inner exhaust gas housing supported within said drive shaft housing and defining therebetween a space in surrounding relation to said inner exhaust gas housing, said inner exhaust gas housing comprising a single piece including integral wall means defining an outer wall defining an open upper end, an exhaust passage extending downwardly from said upper end and within said outer wall and communicating with said exhaust gas port and with said gear case exhaust gas passage, an expansion chamber adjacent said upper end and within said outer wall, and passage means communicating between said exhaust passage and said expansion chamber.

27. A marine propulsion device in accordance with claim 26 wherein said inner exhaust gas housing has a front and a rear, wherein said expansion chamber is located at said front, and wherein said exhaust gas passage is located rearwardly of said expansion chamber.

28. A marine propulsion device in accordance with claim 26 wherein said expansion chamber is defined, in part, by a bottom wall, and wherein said device further comprises restricted passage means in said bottom wall between said exhaust gas passage and said expansion chamber.

29. A marine propulsion device in accordance with claim 26 wherein said inner exhaust gas housing includes outer side walls, wherein said exhaust gas passage includes an upper portion partially defined by spaced inner side walls located in spaced relation to each other and to said outer side walls to respectively define, between said inner and outer side walls, first and second side expansion chambers forming part of said passage means.

30. A marine propulsion device in accordance with claim 29 wherein said first and second side expansion chambers respectively have bottoms and include therein transverse baffles extending between the associated inner and outer side walls to define first and second sub-chambers, said baffles terminating above the bottoms of said side expansion chambers to afford communication between said first and second sub-chambers.

* * * * *